US006603448B2

(12) United States Patent
Kado et al.

(10) Patent No.: US 6,603,448 B2
(45) Date of Patent: Aug. 5, 2003

(54) PLASMA DISPLAY PANEL

(75) Inventors: Hiroyuki Kado, Ibaraki (JP); Kanako Miyashita, Moriguchi (JP)

(73) Assignee: Matsushita Electric Industrial Co., LTD, Osaka-fu (JP)

( * ) Notice: Subject to any disclaimer, the term of this patent is extended or adjusted under 35 U.S.C. 154(b) by 206 days.

(21) Appl. No.: 09/734,509

(22) Filed: Dec. 11, 2000

(65) Prior Publication Data

US 2001/0004250 A1 Jun. 21, 2001

(30) Foreign Application Priority Data

Dec. 16, 1999 (JP) ..... 11-357229

(51) Int. Cl.[7] ..... G09G 3/28
(52) U.S. Cl. ..... 345/60
(58) Field of Search ..... 345/60; 313/582, 313/494, 492; 445/25, 24

(56) References Cited

U.S. PATENT DOCUMENTS 5,349,455 A * 9/1994 Hayashi et al. ..... 313/582
5,525,862 A * 6/1996 Miyazaki ..... 313/494
5,689,153 A * 11/1997 Tanamachi ..... 313/492
5,759,079 A * 6/1998 Tanamachi ..... 445/25
6,097,149 A * 8/2000 Miyaji et al. ..... 313/582

FOREIGN PATENT DOCUMENTS

| | | |
|---|---|---|
| JP | 8287869 | 11/1996 |
| JP | 11185635 | 7/1999 |
| JP | 11213892 | 8/1999 |

* cited by examiner

*Primary Examiner*—Steven Saras
*Assistant Examiner*—Uchendu O. Anyaso

(57) ABSTRACT

A PDP that can maintain favorable color balance is provided. In the PDP which is equipped with back phosphor layers of the three colors red, green, and blue in a back panel, front phosphor layers are provided in a front panel respectively in opposition to back phosphor layers other than the back phosphor layer whose luminance degrades fastest with time among the red, green, and blue back phosphor layers. These front phosphor layers are prone to luminance deterioration caused by ultraviolet radiation or ion bombardment, and therefore accelerate the luminance degradation speeds of their opposite back phosphor layers. Accordingly, the luminance of light emitted from each of the two combinations of the front and back phosphor layers is brought to be more balanced with the luminance of light emitted from the back phosphor layer with the highest luminance degradation speed. Hence the PDP can maintain favorable color balance over a long time.

26 Claims, 11 Drawing Sheets

PLASMA DISPLAY PANEL

BACKGROUND OF THE INVENTION

1. Field of the Invention

The present invention relates to a plasma display panel for use in a display device or the like, and in particular relates to a plasma display panel that offers excellent color balance.

2. Related Art

Among various types of color display devices used for displaying images on computers, televisions, and the like, a plasma display panel (hereinafter, "PDP") has become a focus of attention as a color display device that can realize a slim, lightweight, large-screen display device.

FIG. 1 is a partial perspective and sectional view of a conventional, typical PDP.

In this PDP, a front glass substrate 11 and a back glass substrate 12 are placed in opposition to each other, with barrier ribs 19 being interposed in between. On the surface of the front glass substrate 11 facing the back glass substrate 12, a plurality of display electrodes 13 and a plurality of display scan electrodes 14 (only two pairs of them are shown in the drawing) having a stripe shape are alternately aligned in parallel to each other. The plurality of display electrodes 13 and the plurality of display scan electrodes 14 are then coated with a dielectric layer 15 made of lead glass or the like, and further coated with an MgO protective film 16. This forms a front panel.

On the surface of the back glass substrate 12 facing the front glass substrate 11, a plurality of address electrodes 17 (only four of them are shown in the drawing) having a stripe shape are aligned in parallel, and a dielectric layer 18 made of lead glass or the like is formed on the back glass substrate 12 so as to cover the plurality of address electrodes 17. The barrier ribs 19 are formed between neighboring address electrodes 17. Lastly, back phosphor layers 20R, 20G, and 20B in each of the three colors red (R), green (G), and blue (B) are applied to the gaps between neighboring barrier ribs 19 on the dielectric layer 18. This forms a back panel.

The areas within discharge spaces 21 between the front glass substrate 11 and the back glass substrate 12 where the plurality of pairs of electrodes 13 and 14 intersect with the plurality of address electrodes 17 are cells for light emission. The discharge spaces 21 are filled with an inert gas that contains neon as a main component and a trace quantity of xenon as a buffer gas.

To produce an image display on this PDP, sustain discharge is induced between pairs of electrodes 13 and 14 in cells which should be illuminated, to emit ultraviolet light. This ultraviolet light excites the phosphor layers 20R, 20G, and 20B, as a result of which visible light of the three primary colors red, green, and blue is generated and subjected to an additive process. Hence a full-color display is produced.

The back phosphor layers 20R, 20G, and 20B used in such a PDP are constructed so that favorable color balance is preserved when displaying a white color. Here, the luminance (light intensity) of each of the back phosphor layers 20R, 20G, and 20B in their initial states is different due to different compositions of the red, green, and blue phosphors. To maintain the color balance of the PDP in its initial state and thereby keep the color temperature from decreasing, such a technique has been employed as to set the back phosphor layer 20B having low luminance wider than the back phosphor layers 20R and 20G, or to reduce sustain discharge pulses for the back phosphor layers 20R and 20G through signal processing by a PDP drive circuit, in order to balance the luminance of red and green light with the luminance of the blue light.

Nevertheless, the PDP has the following problems associated with color temperatures.

First, the back phosphor layers 20R, 20G, and 20B deteriorate with illumination time of the PDP, due to the factors such as ion bombardment and ultraviolet radiation during discharge. This means the luminance of each back phosphor layer degrades over time. Here, since the deterioration speeds of the three back phosphor layers differ due to their different compositions, the deteriorating luminance of each back phosphor layer varies by greater amounts as time passes. This disturbs the color balance of the PDP when displaying a white color, and results in a drop in color temperature. Although the color balance can be adjusted to some extent through signal processing by the PDP drive circuit, it is more desirable to keep the color balance as constant as possible.

Second, the aforementioned signal processing technique has conventionally been employed to limit the use of the luminance of the red and green phosphor layers to balance the red light luminance and the green light luminance with the lower blue light luminance, in order to raise the color temperature of the PDP in its initial state. However, such limited use of the luminance of the red and green phosphors causes a decrease in brightness of the PDP.

SUMMARY OF THE INVENTION

The first object of the present invention is to provide a PDP that can maintain favorable color balance for a long time.

The second object of the invention is to provide a PDP with improved brightness in its initial state.

The first object can be fulfilled by providing front phosphor layers respectively in opposition to back phosphor layers, other than a back phosphor layer whose luminance degrades fastest with time, among red, green, and blue back phosphor layers. Since the front phosphor layers are susceptible to luminance deterioration due to ultraviolet radiation and ion bombardment, they serve to accelerate the luminance degradation speeds of the opposite back phosphor layers. Accordingly, the luminance degradation speeds of the back phosphor layers combined with the front phosphor layers are brought to be more balanced with the luminance degradation speed of the back phosphor layer whose luminance degrades fastest, with it being possible to maintain the color balance of the PDP for a long time.

The second object can be fulfilled by providing front phosphor layers respectively in opposition to back phosphor layers, other than a back phosphor layer whose initial luminance utilization factor is the lowest among the red, green, and blue back phosphor layers. In so doing, the back phosphor layers combined with the front phosphor layers increase in luminance, so that the brightness of the PDP in its initial state can be improved while maintaining favorable color balance.

High brightness and favorable color balance of the PDP can also be attained by providing front phosphor layers respectively in opposition to the red, green, and blue back phosphor layers, and setting the visible light transmittance of each front phosphor layer in accordance with the initial luminance of its opposite back phosphor layer.

Here, by using spherical phosphor particles obtained by hydrothermal synthesis for such front and back phosphor layers, the brightness of the PDP is further enhanced.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENT(S)

The following is a description of embodiments of the present invention.

First Embodiment

A PDP and a PDP-equipped display device of the first embodiment of the invention is described below, with reference to drawings.

(Construction of a PDP 100)

Figure 1:
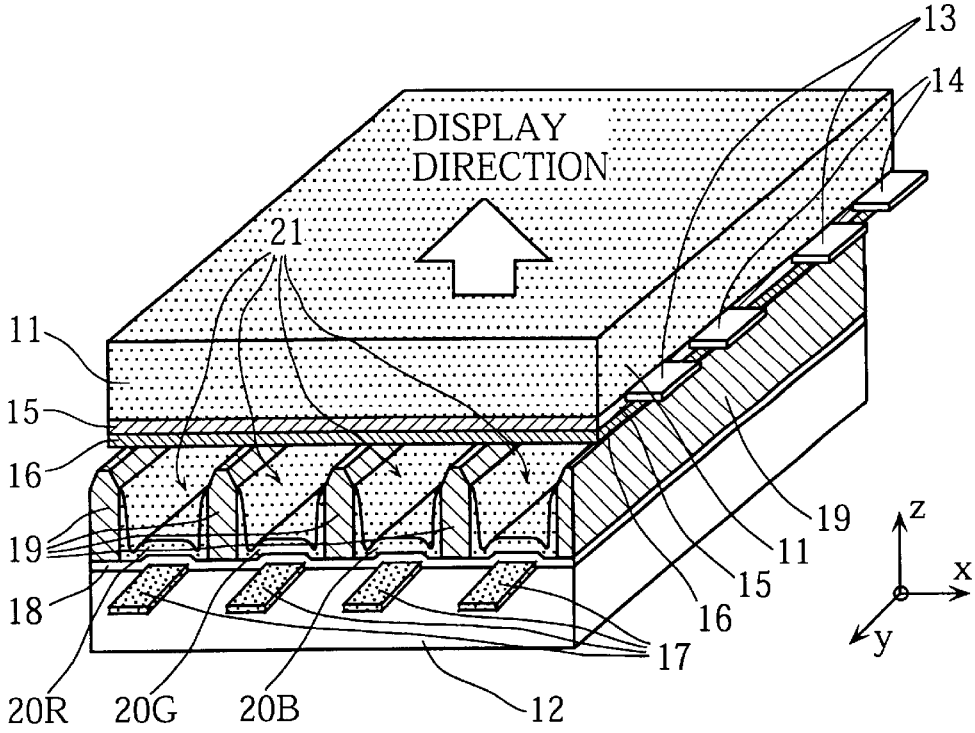
FIG. 1 is a partial perspective and sectional view of a conventional, typical PDP.
Figure 2:
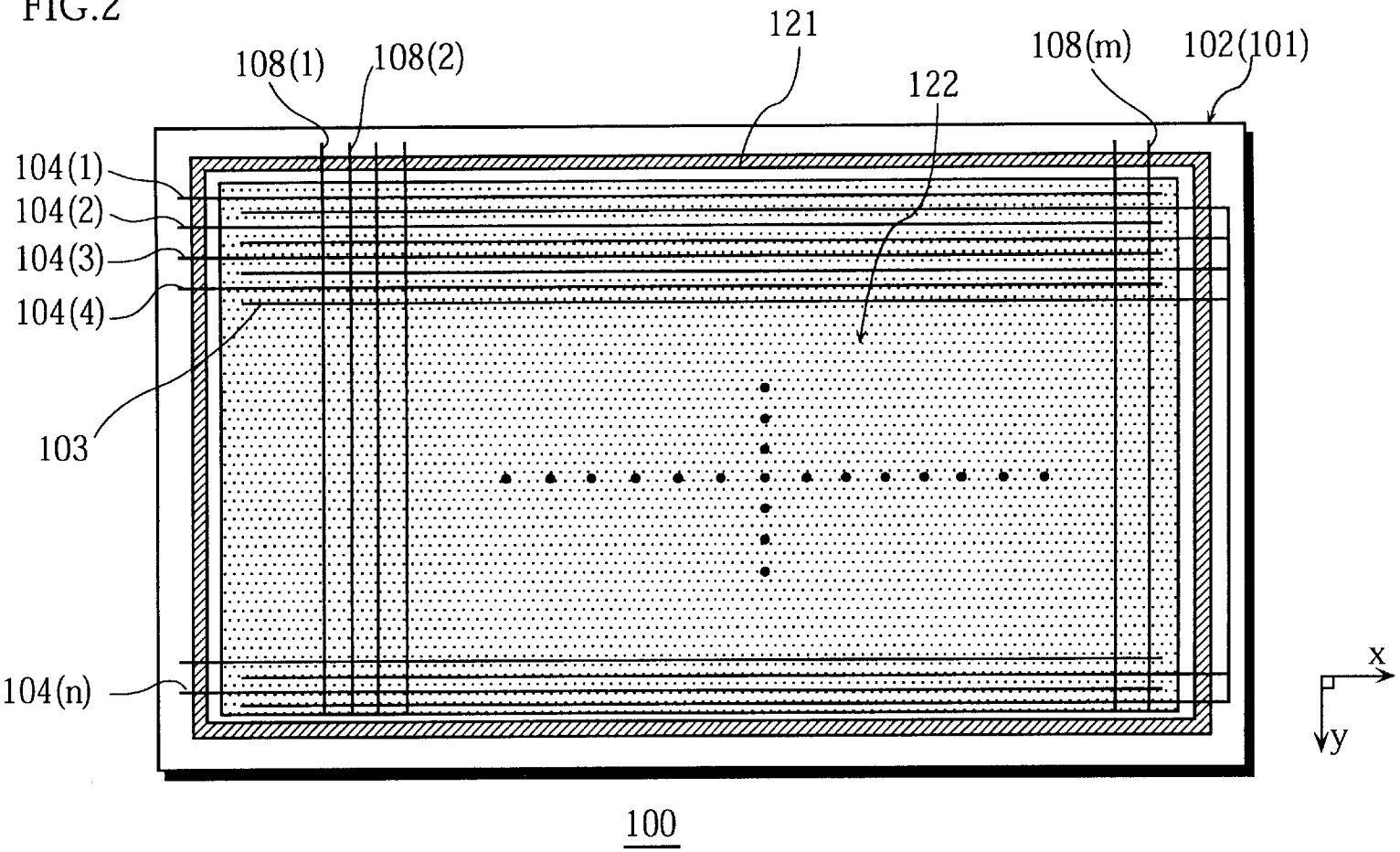
FIG. 2 is a schematic plan view of a PDP according to the first embodiment of the invention, from which a front glass substrate has been removed.
Figure 3:
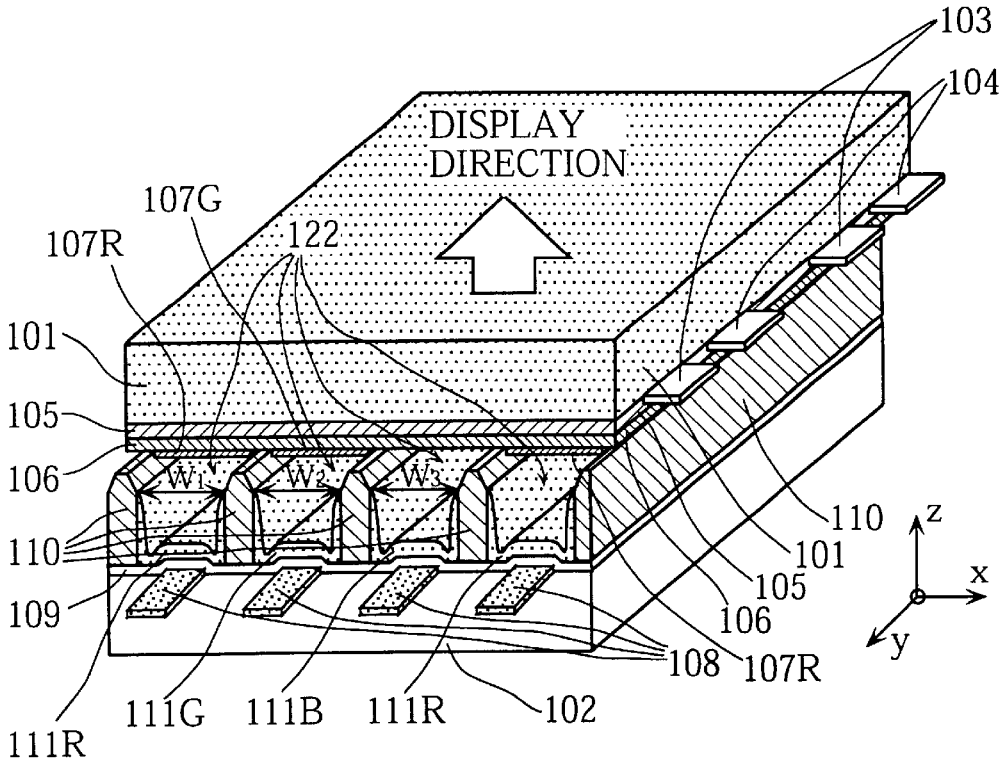
FIG. 3 is a partial perspective and sectional view of the PDP in the first embodiment.

FIG. 2 is a schematic plan view of a PDP 100 from which a front glass substrate 101 has been removed, whereas FIG. 3 is a partial perspective and sectional view of the PDP 100. Note that in FIG. 2 some of display electrodes 103, display scan electrodes 104, and address electrodes 108 are omitted for simplicity's sake. A construction of this PDP 100 is explained with reference to these drawings.

In FIG. 2, the PDP 100 is roughly made up of a front glass substrate 101 (not illustrated), a back grass substrate 102, n display electrodes 103, n display scan electrodes 104, m address electrodes 108, and an airtight sealing layer 121 (the diagonally shaded area in the drawing). The n display electrodes 103, the n display scan electrodes 104, and the m address electrodes 108 together form a matrix of a three-electrode structure. The areas where the pairs of electrodes 103 and 104 intersect with the address electrodes 108 are cells.

In FIG. 3, the front glass substrate 101 and the back glass substrate 102 are set facing each other, with stripe-shaped barrier ribs 110 being interposed in between.

The front glass substrate 101, the display electrodes 103, the display scan electrodes 104, a dielectric glass layer 105, a protective layer 106, and front phosphor layers 107R and 107G constitute a front panel.

The display electrodes 103 and the display scan electrodes 104 are both made of silver, and are alternately arranged in parallel in stripes on the surface of the front glass substrate 101 facing the back glass substrate 102.

The dielectric glass layer 105 is made of lead glass or the like, and is formed on the surface of the front glass substrate 101 so as to cover the display electrodes 103 and the display scan electrodes 104.

The protective layer 106 is made of magnesium oxide (MgO) or the like, and is formed on the surface of the dielectric glass layer 105.

The front phosphor layers 107R and 107G are made up of phosphor particles that emit light of the respective colors red (R) and green (G). These front phosphor layers 107R and 107G are disposed on the protective layer 106 so as to be in opposition to back phosphor layers 111R and 111G on the back glass substrate 102.

On the other hand, the back glass substrate 102, the address electrodes 108, a visible light reflective layer 109, the barrier ribs 110, and back phosphor layers 111R, 111G, and 111B constitute a back panel.

The address electrodes 108 are made of silver, and are aligned in parallel on the surface of the back glass substrate 102 facing the front glass substrate 101.

The visible light reflective layer 109 is made of dielectric glass containing titanium oxide or the like, and is formed on the surface of the back glass substrate 102 so as to cover the address electrodes 108. The visible light reflective layer 109 serves to reflect visible light generated from the back phosphor layers 111R, 111G, and 111B, and at the same time serves as a dielectric layer.

The barrier ribs 110 are arranged on the surface of the visible light reflective layer 109 so as to be parallel with the address electrodes 108. The back phosphor layers 111R, 111G, and 111B are applied in turn, to the sides of adjacent barrier ribs 110 and the surface of the visible light reflective layer 109 therebetween. Here, the gaps between neighboring barrier ribs 110 where the back phosphor layers 111R, 111G, and 111B are arranged may be given uneven widths, in accordance with differences in luminance of the back phosphor layers 111R, 111G, and 111B. For instance, the widths W1, W2, and W3 of the respective back phosphor layers 111R, 111G, and 111B can be set such that W1<W2<W3. Given that the front phosphor layers are provided only for the limited colors red and green, there is a danger that the color balance of the PDP 100 may be disturbed when these front phosphor layers 107R and 107G emit light. However, by adopting such an uneven cell pitch structure, the areas of the phosphors which emit light in each of the three colors are adjusted, so that the color balance of the PDP 100 in its initial state can be controlled to some extent, without resort to signal processing.

The back phosphor layers 111R, 111G, and 111B are made up of phosphor particles that emit light of the respective colors red (R), green (G), and blue (B). The thickness of each of the back phosphor layers 111R, 111G, and 111B on the visible light reflective layer 109 in a direction z is preferably about 8 to 20 times the average particle diameter of the phosphor particles that make up the back phosphor layer. To be more specific, when a certain amount of ultraviolet light is generated in a discharge space 122, the back phosphor layer needs to absorb the ultraviolet light without allowing the light to pass through, in order to ensure sufficient luminous intensity (illumination efficiency). To do so, the thickness of the back phosphor layer need be at least equivalent to 8 phosphor particles, and is more preferably equivalent to 10 phosphor particles. If the thickness is greater than that, the illumination efficiency of the back phosphor layer would become almost saturated. Also, if the thickness is equivalent to more than 20 phosphor particles, enough room for the discharge space 122 will not able to be secured.

The front panel and the back panel are then sealed together along their edges, by the airtight sealing layer 121. A discharge gas (e.g. a mixture of helium and xenon) is filled in discharge spaces 122 formed between the front and back panels.

Figure 4:
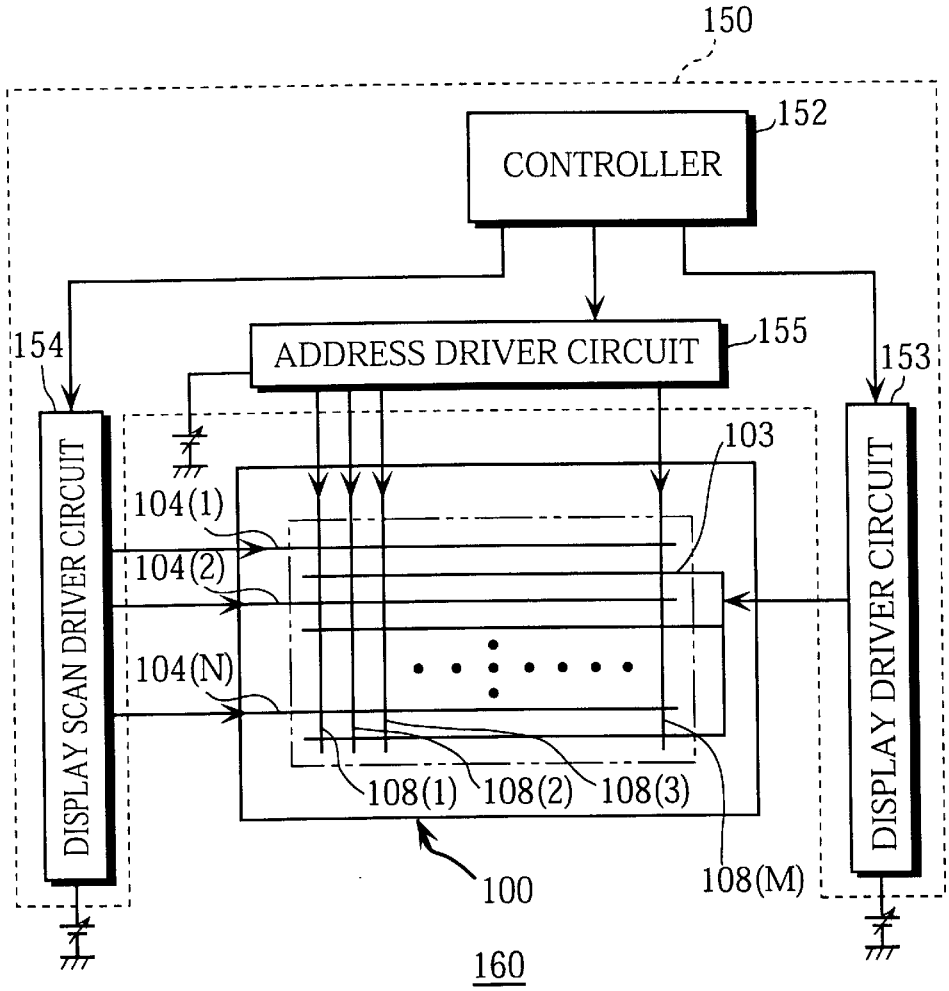
FIG. 4 is a block diagram of a PDP-equipped display device according to the first embodiment.

Such a constructed PDP 100 and a PDP drive device 150 shown in FIG. 4 are connected together, thereby constituting a PDP-equipped display device 160. To drive the PDP-equipped display device 160, the PDP 100 is connected to a display driver circuit 153, a display scan driver circuit 154, and an address driver circuit 155 in the PDP drive device 150. Under the control of a controller 152, a voltage is applied to a display scan electrode 104 and an address electrode 108 in a cell which is to be illuminated, to induce address discharge between them. After wall charges are accumulated, a pulse voltage is applied to each pair of display electrode 103 and display scan electrode 104, to initiate sustain discharge in the cell in which wall charges have been accumulated. Due to this sustain discharge, ultraviolet light is generated and excites a back phosphor layer (and a front phosphor layer) which emits visible light, as a result of which the cell is illuminated. By controlling the presence or absence of light emission of each colored cell in the PDP 100, a color image is displayed. Here, incorporating the uneven cell pitch structure mentioned above into the PDP 100 allows the color balance to be adjusted to a certain extent. However, should such an uneven cell pitch structure be not enough to fully adjust the color balance, it is desirable to perform such signal processing that reduces the numbers of sustain discharge pulses relatively for the three colors, in order to adjust the color balance and improve the color temperature of the PDP 100.

(Construction of the Front Panel)

A construction of the front panel that is characteristic of the present invention is explained below.

Figure 5:
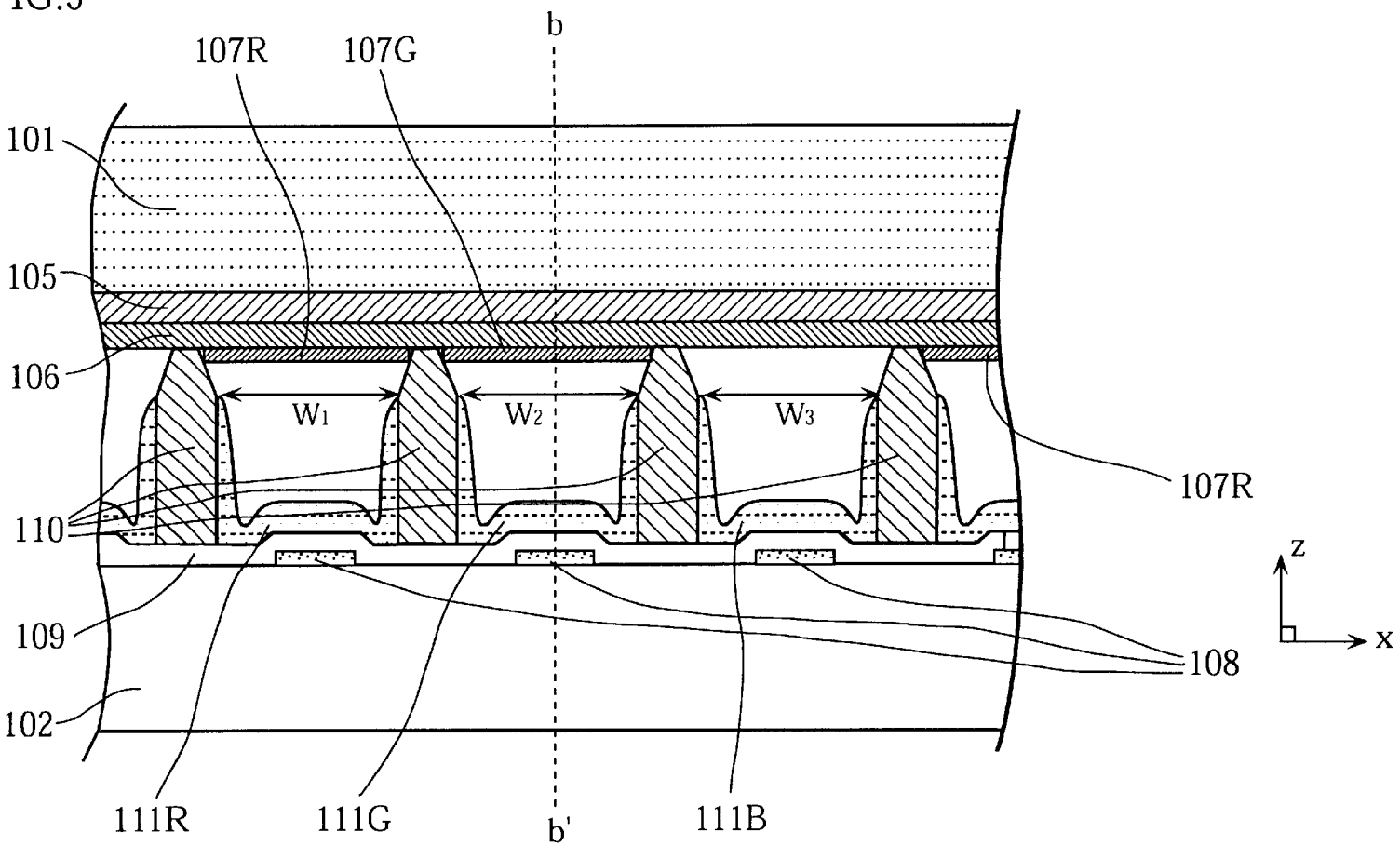
FIG. 5 is an expanded sectional view of part of the PDP shown in FIG. 3, looking at in a direction y.

FIG. 5 is an expanded sectional view of part of the PDP 100 shown in FIG. 3, looking at in a direction y.

As shown in the drawing, the front phosphor layers 107R and 107G are provided in the front panel in opposition to the back phosphor layers 111R and 111G, while no front phosphor layer is provided in opposition to the back phosphor layer 111B whose luminance deteriorates fastest with time among the back phosphor layers 111R, 111G, and 111B. Here, it is desirable that each of the front phosphor layers 107R and 107G be made up of phosphor particles which are sufficiently small in particle diameter and spherical in shape, like those that can be obtained by hydrothermal synthesis. When phosphor particles that are not only small but also spherical are used, the total surface area of phosphor particles that contributes to light emission is larger than in the case where non-spherical phosphor particles are used. Accordingly, by applying spherical phosphor particles to the front phosphor layer 107R (107G), the total surface area of phosphor particles contributing to light emission is increased, with it being possible to improve illumination efficiency of the front phosphor layer 107R (107G). The phosphor particles used in the front phosphor layers 107R and 107G will be explained in detail later.

Figure 6:
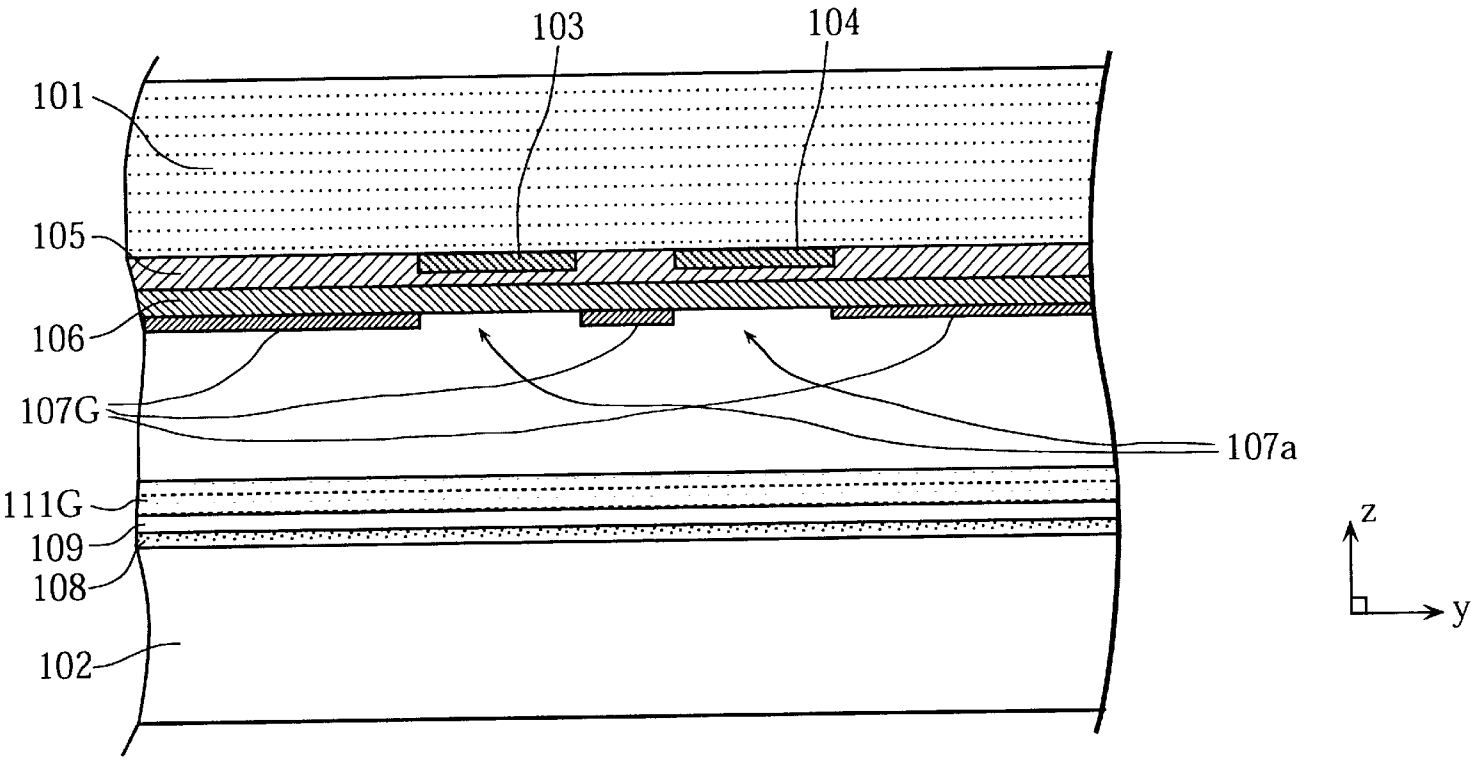
FIG. 6 is an expanded sectional view of part of the PDP shown in FIG. 3, looking at in a direction x.

FIG. 6 is an expanded sectional view of the PDP 100 taken on a line b–b' in FIG. 5, looking at in a direction x.

In the drawing, there are gaps 107*a* on parts of the surface of the protective layer 106 that correspond to the display electrode 103 and the display scan electrode 104. These gaps 107*a* allow the electrodes 103 and 104 to be exposed to the discharge spaces 122, thereby facilitating sustain discharge between them.

(Effects Achieved by the Front Phosphor Layers 107R and 107G)

The display electrode 103 and the display scan electrode 104 that perform sustain discharge are positioned closer to the front phosphor layers 107R and 107G than to the back phosphor layers 111R and 111G equipped in the back panel. This being so, during the operation of the PDP 100, the front phosphor layer 107R (107G) tends to be more easily affected by ultraviolet radiation and ion bombardment induced by sustain discharge between the display electrode 103 and the display scan electrode 104, than the back phosphor layer 111R (111G). This indicates the luminance of the front phosphor layer 107R (107G) degrades faster than that of the back phosphor layer 111R (111G). The presence of such a front phosphor layer 107R (107G) that degrades faster in luminance accelerates the speed at which the luminance of the emitted red (green) light degrades over time. In other words, when the back phosphor layer 111R (111G) and the front phosphor layer 107R (107G) are both present, the red (green) light luminance degrades faster than when only the back phosphor layer 111R (111G) is present (the speed at which luminance degrades over time is hereafter referred to as "luminance degradation speed"). Accordingly, by providing the front phosphor layers in opposition to the back phosphor layers 111R and 111G but not in opposition to the back phosphor layer 111B whose luminance degrades fastest of the three back phosphor layers, the luminance degradation speeds of the red and green light approach the luminance degradation speed of the blue light. As a result, even after the PDP 100 is illuminated for a long time, the luminance degradation speeds of the red, green, and blue light remain more or less balanced, so that the color temperature (color balance) of the PDP 100 can be kept from changing greatly with time. The luminance degradation speeds of the red, green, and blue light are examined more closely below.

Figure 7:
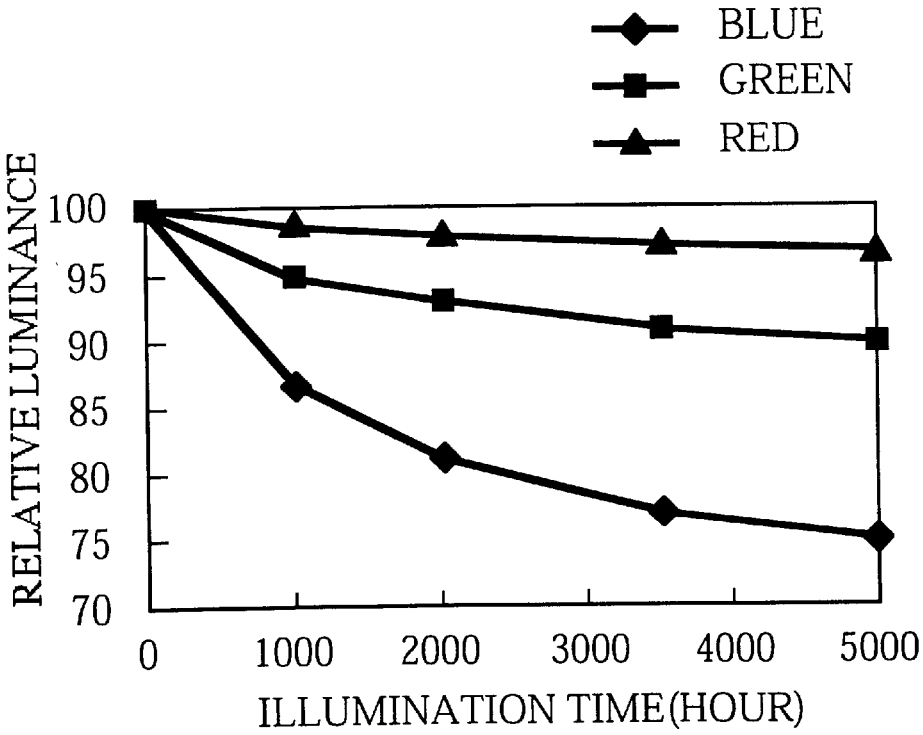
FIG. 7 is a graph showing the luminance degradation of red, green, and blue light in a PDP which is equipped only with back phosphor layers.

FIG. 7 is a graph showing differences in luminance degradation speed of the back phosphor layers 111R, 111G, and 111B. This graph shows relative luminance of red, green, and blue light with respect to illumination time, when the PDP is equipped only with the back phosphor layers 111R, 111G, and 111B.

As the red, green, and blue phosphors, the following conventionally known phosphors are used.

| | |
|---|---|
| Red phosphor: | $(Y,Gd)BO_3$:Eu |
| Green phosphor: | $Zn_2SiO_4$:Mn |
| Blue phosphor: | $BaMgAl_{10}O_{17}$:Eu |

The relative luminance referred to here is luminance relative to initial luminance of each phosphor.

As shown in the drawing, after the PDP was illuminated 5000 hours, the luminance of the red light degraded by 3% and the luminance of the green light degraded by 10%, whereas the luminance of the blue light degraded by 25%. This demonstrates that the luminance degradation speed of blue light is the highest of the three colors.

Figure 8:
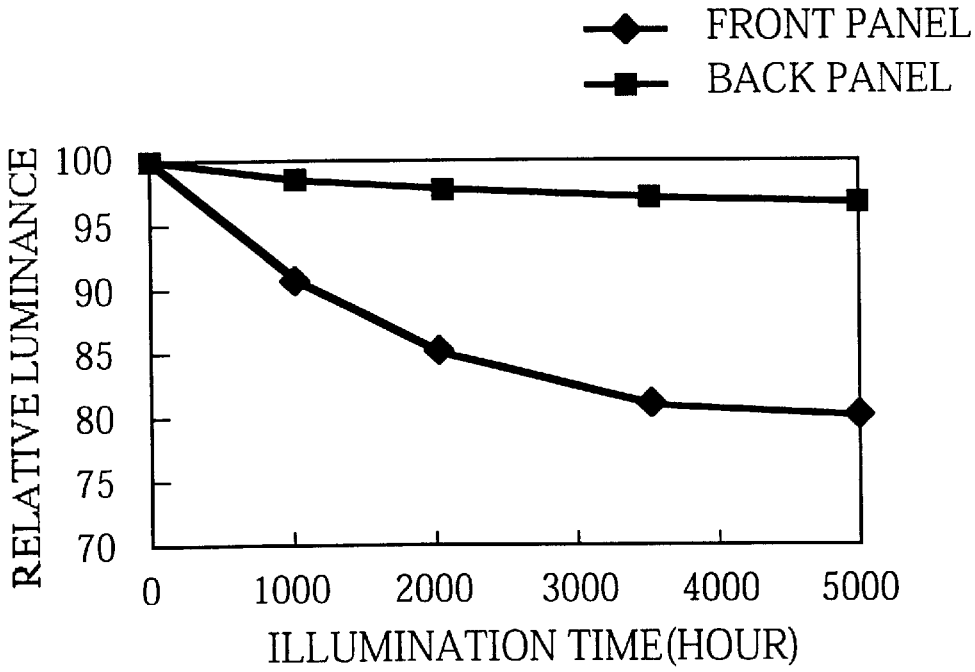
FIG. 8 is a graph showing the luminance degradation of red light in a PDP which is equipped only with front phosphor layers or back phosphor layers.

FIG. 8 is a graph showing differences in luminance degradation speed of the front phosphor layer 107R and the back phosphor layer 111R, taking red light whose luminance degrades slowest of the three colors, as an example. The graph shows relative luminance of red light with respect to illumination time, in each of the cases where the PDP is equipped with the front phosphor layer 107R and the PDP is equipped with the back phosphor layer 111R. As the red phosphor, $(Y,Gd)BO_3$:Eu is used.

In the case of the back phosphor layer 111R, the red light luminance degraded by only 3% even after 5000 hours of illumination. Meanwhile, in the case of the front phosphor layer 107R, the red light luminance degraded by 20% after 5000 hours. This indicates that even for the red phosphor whose luminance is least prone to deterioration among the three colored phosphors, the luminance deteriorates relatively fast with time in the front phosphor layer.

As can be seen from the above results, a luminance degradation speed accelerates when both a front phosphor layer and a back phosphor layer are present, in comparison with when only a back phosphor layer is present.

Figure 9:
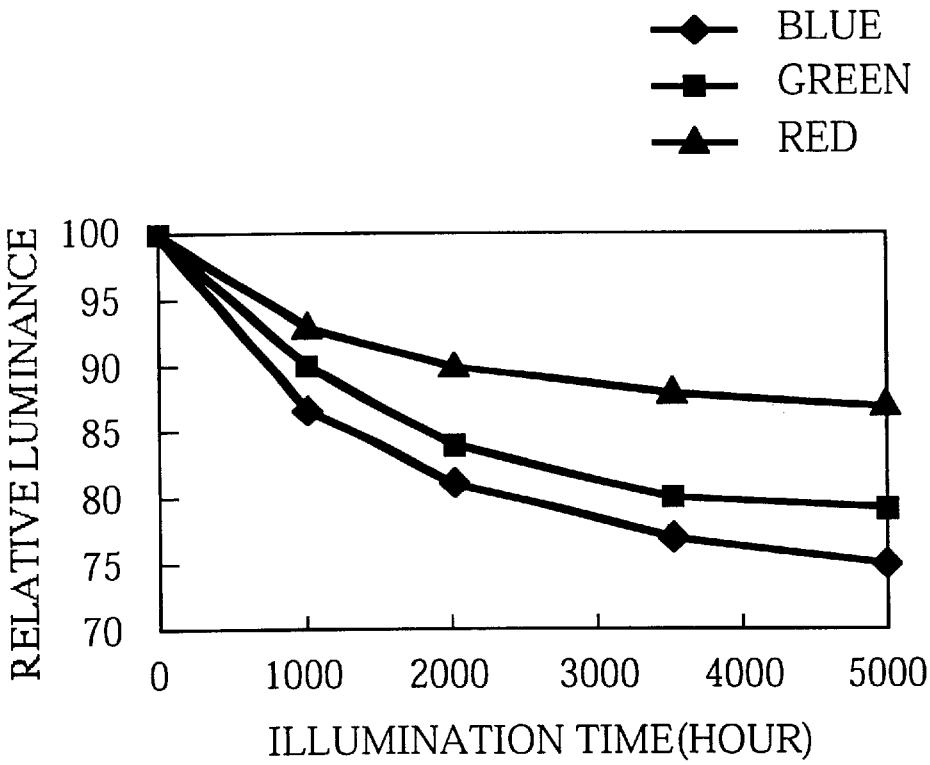
FIG. 9 is a graph showing the luminance degradation of red, green, and blue light in the PDP of the first embodiment.

FIG. 9 is a graph showing differences in luminance degradation speed of red, green, and blue light, when the PDP is equipped with the back phosphor layers 111R, 111G, and 111B and the front phosphor layers 107R and 107G. The graph shows relative luminance of each colored light with respect to illumination time.

As illustrated, the red light luminance degraded by 12% after 5000 hours of illumination. Also, the green light luminance degraded by 20% after 5000 hours. When comparing this with FIG. 7, it is clear that the luminance degradation speeds of the red and green light were accelerated by the presence of the front phosphor layers 107R and 107G.

(Visible Light Transmittance of the Front Phosphor Layers 107R and 107G)

When the front phosphor layer 107R (107G) is present on the front glass substrate 101, visible light emitted from the back phosphor layer 111R (111G) may not be able to pass through the front glass substrate 101. This causes a decrease in brightness of the PDP 100. To avoid such a problem, it is desirable that the front phosphor layer 107R (107G) has higher visible light transmittance than the back phosphor layer 111R (111G). The visible light transmittance of the front phosphor layer 107R (107G) can be increased by changing the thickness and/or intergranular voidage of the front phosphor layer 107R (107G) (the intergranular voidage denotes the proportion of a volume occupied by voids per unit area in the front phosphor layer 107R (107G)). More specifically, the visible light transmittance of the front phosphor layer 107R (107G) can be increased by reducing the layer thickness and/or increasing the intergranular voidage. By adjusting visible light transmittance in such a way, the red (green) light luminance can be adjusted, with it being possible to control the color temperature of the PDP 100 itself. Desirable states of phosphors for use in these phosphor layers will be explained later.

In the PDP 100 of the first embodiment, the front phosphor layers 107R and 107G are provided in opposition to the back phosphor layers 111R and 111G, while no front phosphor layer is provided in opposition to the back phosphor layer 111B whose luminance deteriorates fastest of the three back phosphor layers. In doing so, the luminance degradation speeds of red, green, and blue light are more balanced, so that the color temperature of the PDP 100 can be kept from dropping greatly with illumination time.

This embodiment describes an example in which front phosphor layers are provided for the back phosphor layers 111R and 111G but not for the back phosphor layer 111B with the highest luminance degradation speed. However, a front phosphor layer may be provided only for the back phosphor layer 111R with the lowest luminance degradation speed. In this way, decreases in color temperature of the PDP 100 can be suppressed, though to a lesser extent. Alternatively, front phosphor layers may be provided for all of the back phosphor layers 111R, 111G, and 111B, if the visible light transmittance of the blue front phosphor layer is made higher than the other front phosphor layers by reducing its volume through a reduction of the layer thickness or other means. In this way, decreases in color temperature of the PDP 100 can be suppressed, though to a lesser extent.

(Manufacturing Method of the PDP 100)

A method for manufacturing the PDP 100 is described below, with reference to FIGS. 2 and 3.

(Manufacture of the Front Panel)

First, the n display electrodes 103 and the n display scan electrodes 104 (only two pairs are shown in FIG. 3) having a stripe shape are alternately formed in parallel on the front glass substrate 101. The dielectric glass layer 105 is then formed on the front glass substrate 101 over the n display electrodes 103 and the n display scan electrodes 104. After this, the protective layer 106 is formed on the dielectric glass layer 105.

Here, the n display electrodes 103 and the n display scan electrodes 104 are both made of silver, and are formed by applying a silver paste as an electrode material to the surface of the front glass substrate 101 by screen printing, and then firing the result.

The dielectric glass layer 105 is formed by applying a paste including a lead glass substance to the surface of the front glass substrate 101 by screen printing, and then firing the result at a predetermined temperature (560° C.) for a predetermined period (20 minutes), so as to have a predetermined thickness (about 20 $\mu$m). As an example paste including a lead glass substance, a mixture of PbO (70 wt %), $B_2O_3$ (15 wt %), $SiO_2$ (10 wt %), $Al_2O_3$ (5 wt %), and an organic binder (10% of ethyl cellulose dissolved in $\alpha$-terpineol) is used. The organic binder is a substance obtained by dissolving a resin in an organic solvent. Here, a resin such as an acrylic resin and an organic solvent such as butyl carbitol are applicable instead of etyle cellulose and $\alpha$-terpineol. Also, a dispersant such as glycertrioleate may be mixed into the organic binder.

The protective layer 106 is made of MgO, and is formed using sputtering or CVD (chemical-vapor deposition) so as to have a predetermined thickness (about 0.5 $\mu$m).

Following this, a phosphor ink in paste form made up of phosphor particles of red (R) (green (G)) and an organic binder is applied to the surface of the protective layer 106 using screen printing, and the result is fired at a temperature of 400 to 590° C. to destroy the organic binder. As a result, the phosphor particles are bound together to form the front phosphor layer 107R (107G). Here, photolithography may be employed instead of screen printing.

This completes the formation of the front panel.

(Manufacture of the Back Panel)

First, a silver paste as an electrode material is applied to the surface of the back glass substrate 102 by screen printing, and then the result is fired to form the m address electrodes 108 aligned in a row. Then, a paste containing a lead glass substance is applied to the surface of the back glass substrate 102 over the m address electrodes 108 by screen printing, to form the visible light reflective layer 109. Further, a paste containing the same kind of lead glass substance is repeatedly applied in a predetermined pitch to the surface of the visible light reflective layer 109 by screen painting, and the result is fired to form the barrier ribs 110. With these barrier ribs 110, the discharge space is partitioned in the direction x into the plurality of discharge spaces 122 corresponding to individual cells for light emission.

Once the barrier ribs 110 have been formed, a phosphor ink in paste form which is made up of phosphor particles of red (R) (green (G), blue (B)) and an organic binder is applied to the sides of neighboring barrier ribs 110 and the surface of the visible light reflective layer 109 exposed between the neighboring barrier ribs 110, and then fired at a temperature of 400 to 590° C. to destroy the organic binder. As a result, the phosphor particles are bound together to form the back phosphor layer 111R (111G, 111B). The phosphor particles used for each of the back phosphor layers are preferably those obtained by hydrothermal synthesis, for the same reason stated for the front phosphor layers 107R and 107G.

This completes the formation of the back panel.

(Completion of the PDP 100 by Sealing the Front and Back Panels)

The manufactured front panel and back panel are laminated so that the n pairs of electrodes 103 and 104 intersect with the m address electrodes 108. Sealing glass is interposed between the front and back panels along their edges, and fired at a temperature of around 450° C. for 10 to 20 minutes, to form the airtight sealing layer 121. Hence the front and back panels are fixed together. Once the inside of the discharge spaces 122 has been exhausted to form a high vacuum (e.g. $1.1\times10^{-4}$ Pa), a discharge gas (e.g. an inert gas of He—Xe or Ne—Xe) is filled in the discharge spaces 122 at a certain pressure. This completes the PDP 100.

Phosphor Inks and Phosphor Particles

In the above manufacturing process, a phosphor ink which is applied to the front panel and the back panel is prepared by mixing phosphor particles of each color, a binder, and a solvent, so as to have a viscosity of 15 to 3000 centipoise. A surfactant, silica, a dispersant (0.1 to 5 wt %), and the like may be added to such a phosphor ink as necessary.

As red phosphor particles, a compound such as $(Y_{1-x-y}Gd_x)BO_3:Eu_y$ or $Y_{2-x}O_3:Eu_x$ is used. In each of these compounds, the element Eu substitutes for part of the element Y in the host material. Here, the substitution amount X of Eu for Y is preferably $0.05\leqq X\leqq 0.20$. A substitution amount larger than that is believed to be impractical, as the luminance is increased but also the luminance degradation speed is accelerated markedly. Likewise, a substitution amount below the above range is impractical, because the composition ratio of Eu that behaves as the luminescence center decreases, which causes such deterioration in luminance that renders the phosphor unusable.

As green phosphor particles, a compound such as $Ba_{1-x}Al_{12}O_{19}:Mn_x$ or $Zn_{2-x}SiO_4:Mn_x$ is used. $Ba_{1-x}Al_{12}O_{19}:Mn_x$ is a compound in which the element Mn substitutes for part of the element Ba in the host material, whereas $Zn_{2-x}SiO_4$:Mnx is a compound in which the element Mn substitutes for part of the element Zn in the host material. The substitution amount X of Mn for Ba or Zn is preferably $0.01\leqq X\leqq 0.10$, for the same reason stated above.

As blue phosphor particles, a compound such as Ba1-x $MgAl_{10}O_{17}:Eu_x$ or $Ba_{1-x}MgAl_{14}O_{23}:Eu_x$ is used. In each of these compounds, the element Eu substitutes for part of the element Ba in the host material. The substitution amount X of Eu for Ba is preferably $0.03\leqq X\leqq 0.25$ in the former blue phosphor, and $0.03\leqq X\leqq 0.20$ in the latter blue phosphor, for the same reason stated above.

These colored phosphor particles may be prepared by a conventional firing method (see Japanese Laid-Open Patent Application H11-144625). However, if spherical phosphor particles (which are not subjected to a grinding process) obtained by hydrothermal synthesis are used, the luminance of the phosphor can be enhanced. The hydrothermal synthesis will be explained in detail later.

As the binder which is mixed with the phosphor ink, ethyl cellulose or an acrylic resin (constituting 0.1 to 10 wt % of the ink) can be adopted. As the solvent, α-terpineol or butyl carbitol can be adopted. Alternatively, a high polymer such as PMA (polymethacrylic acid) or PVA (polyvinyl alcohol) may be used as the binder, and water or an organic solvent such as diethylene glycol or methyl ether may be used as the solvent.

(Hydrothermal Synthesis for Phosphor Particles)

As a preferable method for creating phosphor particles used in the front and back phosphor layers in this embodiment, hydrothermal synthesis is introduced below. The hydrothermal synthesis is a method of compound synthesis and crystal growth that exploits excellent dissolution, precipitation, and reaction properties of a high-temperature, high-pressure aqueous solution (heated water).

(1) Blue Phosphor (1-1) $Ba_{1-x}MgAl_{10}O_{17}:Eu_x$

First, in a mixed liquor generation process, barium nitrate $Ba(NO_3)_2$, magnesium nitrate $Mg(NO_3)_2$, aluminum nitrate $Al(NO_3)_3$, and europium nitrate $Eu(NO_3)_2$ as raw materials are mixed with a mole ratio of 1-X:1:10:X ($0.03\leqq X\leqq 0.25$). The result is then dissolved into an aqueous solvent to form a mixed liquor. Here, ion-exchange water or pure water is suitable as the aqueous solvent as they do not contain impurities, but ion-exchange water or pure water which includes a nonaqueous solvent (such as methanol or ethanol) is also usable.

In a hydration process that follows, a basic aqueous solution (e.g. an ammonia aqueous solution) is dropped into the mixed liquor, to create a hydrate. After the hydrate is washed, the result is fired at a predetermined temperature (600° C.) for a predetermined period (10 hours), to remove water and nitric acid.

In a hydrothermal synthesis process that follows, the fired particles, an aqueous medium (preferably ion-exchange water, but a mixture of ion-exchange water and a nonaqueous solvent such as methanol or ethanol is also applicable), and a small quantity of an aluminum powder are put in a container made of a material, such as gold or platinum, that is resistant to corrosion and heat. Then, through the use of a device such as an autoclave that heats substances under high pressure, hydrothermal synthesis is performed in a high-pressure container at a predetermined temperature (200–800° C.) and a predetermined pressure (3 MPa to 70 MPa), for a predetermined period (12 to 20 hours).

The obtained powder is then subjected to firing (heat treatment) in a reduction atmosphere (e.g. an atmosphere containing 5% of hydrogen and 95% of nitrogen), at a predetermined temperature (1000° C.) for a predetermined period (2 hours). As a result, desired blue phosphor particles $Ba_{1-x}MgAl_{10}O_{17}:Eu_x$ are obtained.

Phosphor particles obtained by such hydrothermal synthesis are spherical in shape, and smaller in particle diameter (about 0.1–3.0 μm on average) than those produced by conventional solid phase reaction. The spherical shape here denotes a shape of a phosphor particle in which the ratio of the minor to major axes is in a range such as 0.9 to 1.0. To say that the phosphor particles are in spherical shape, most phosphor particles, though not all, need to be within this range.

(1-2) $Ba_{1-x}MgAl_{14}O_{23}:Eu_x$

This type of blue phosphor can be made in the same way as $Ba_{1-x}MgAl_{10}O_{17}:Eu_x$, using different raw materials.

As the raw materials, barium hydroxide $Ba(OH)_2$, magnesium hydroxide $Mg(OH)_2$, aluminum hydroxide $Al(OH)_3$, and europium hydroxide $Eu(OH)_2$ are mixed with a mole ratio of 1-X:1:14:X ($0.03 \leqq X \leqq 0.20$). Following this, the hydration process, the hydrothermal synthesis process, and the firing process are carried out in the same way as $Ba_{1-x}MgAl_{10}O_{17}:Eu_x$, as a result of which desired blue phosphor particles $Ba_{1-x}MgAl_{14}O_{23}:Eu_x$ are obtained. These phosphor particles are about 0.1 to 3.0 μm in average particle diameter, and substantially spherical in shape.

(2) Green Phosphor (2-1) $Zn_{2-x}Sio_4:Mn_x$

In a mixed liquor generation process, zinc nitrate $Zn(NO_3)$, silicon nitrate $Si(NO_3)_2$, and manganese nitrate $Mn(NO_3)_2$ as raw materials are mixed with a mole ratio of 2-X:1:X ($0.0 \leqq X \leqq 0.10$). The result is then dissolved into ion-exchange water to form a mixed liquor.

In a hydration process, a basic aqueous solution (e.g. an ammonia aqueous solution) is added to the mixed liquor, to create a hydrate.

In a hydrothermal synthesis process, the hydrate and ion-exchange water are put in a container made of gold or platinum that is resistant to corrosion and heat. Then, through the use of a device such as an autoclave, hydrothermal synthesis is performed in a high-pressure container at a predetermined temperature (200–350° C.) and a predetermined pressure (1 MPa to 35 MPa), for a predetermined period (2 to 10 hours). Then, by drying the resulting particles, desired green phosphor particles $Zn_{2-x}SiO_4:Mn_x$ are acquired. These phosphor particles are approximately 0.1–3.0 μm in average particle diameter, and spherical in shape.

(2-2) $Ba_{1-x}Al_{12}O_{19}:Mn_x$

In a mixed liquor generation process, barium nitrate $Ba(NO_3)_2$, aluminum nitrate $Al(NO_3)_2$, and manganese nitrate $Mn(NO_3)_2$ as raw materials are mixed with a mole ratio of 1-X:12:X ($0.0 \leqq X \leqq 0.10$). The result is then dissolved into ion-exchange water to form a mixed liquor.

In a hydration process, a basic aqueous solution (e.g. an ammonia aqueous solution) is added to the mixed liquor, to create a hydrate.

In a hydrothermal synthesis process, the hydrate and ion-exchange water are put in a container made of a material, such as gold or platinum, that is resistant to corrosion and heat. Then, through the use of a device such as an autoclave, hydrothermal synthesis is performed in a high-pressure container at a predetermined temperature (200–350° C.) and a predetermined pressure (1 MPa to 30 MPa), for a predetermined period (2 to 20 hours).

After the resulting particles are dried, desired green phosphor particles $Ba_{1-x}Al_{12}O_{19}:Mn_x$ are acquired. These phosphor particles are approximately 0.1–3.0 μm in average particle diameter, and spherical in shape.

(3) Red Phosphor (3-1) $(Y_{1-x-y}Gd_x)BO_3:Eu_y$

In a mixed liquor generation process, yttrium hydroxide $Y_2(OH)_3$, gadolinium hydroxide $Gd_2(OH)_3$, boracic acid $H_3BO_3$, and europium hydroxide $Eu_2(OH)_3$ as raw materials are mixed with a mole ratio of 1-x-y:x:1:y ($0.00 \leqq x \leqq 0.40$, $0.05 \leqq y \leqq 0.20$). The result is then dissolved into ion-exchange water to form a mixed liquor.

In a hydration process, a basic aqueous solution (e.g. an ammonia aqueous solution) is added to the mixed liquor, to create a hydrate.

In a hydrothermal synthesis process, the hydrate and ion-exchange water are put in a container made of a material, such as gold or platinum, that is resistant to corrosion and heat. Then, through the use of a device such as an autoclave, hydrothermal synthesis is performed in a high-pressure container at a predetermined temperature (200–350° C.) and a predetermined pressure (1 MPa to 30 MPa), for a predetermined period (3 to 12 hours).

After the resulting particles are dried, desired red phosphor particles $(Y_{1-x-y}Gd_x)BO_3:Eu_y$ are acquired. These phosphor particles are approximately 0.1–3.0 μm in average particle diameter, and spherical in shape.

(3-2) $Y_{2-x}O_3:Eu_x$

In a mixed liquor generation process, yttrium nitrate $Y_2(NO_3)_2$ and europium nitrate $Eu(NO_3)_2$ as raw materials are mixed with a mole ratio of 2-X:X ($0.05 \leqq X \leqq 0.30$). The result is then dissolved into ion-exchange water to form a mixed liquor.

In a hydration process, a basic aqueous solution (e.g. an ammonia aqueous solution) is added to the mixed liquor, to create a hydrate.

In a hydrothermal synthesis process, the hydrate and ion-exchange water are put in a container made of a material, such as gold or platinum, that is resistant to corrosion and heat. Then, through the use of a device such as an autoclave, hydrothermal synthesis is performed in a high-pressure container at a predetermined temperature (200–350° C.) and a predetermined pressure (1 MPa to 30 MPa), for a predetermined period (3 to 12 hours).

After the resulting particles are dried, desired red phosphor particles $Y_{2-x}O_3:Eu_x$ are acquired. These phosphor particles are approximately 0.1–3.0 μm in average particle diameter, and spherical in shape. Such a particle diameter and shape lend themselves to use for formation of phosphor layers that have excellent luminescent characteristics.

Thus, according to hydrothermal synthesis, phosphor particles having a spherical shape and a small average particle diameter (approximately 0.1–3.0 μm) can be obtained, which do not require grinding or screening. Accordingly, surfaces of such phosphor particles are kept free of oxygen defects associated with grinding, so that the luminance and the luminance degradation speed of the phosphor can be significantly improved. Also, given that ultraviolet light penetrates only such a short distance into each phosphor particle (about several nanometers from the particle surface) that almost only the surface of the particle illuminates, if the phosphor particles that make up the phosphor layer are small with an average particle diameter no greater than 3.0 μm, the total surface area of phosphor particles that contributes to illumination increases. As a result, the phosphor layer can maintain high luminance.

Also, most of the phosphor particles according to hydrothermal synthesis are monocrystalline, as they are crystalized in heated water. This indicates that each phosphor particle hardly contains any grain boundaries, and so is relatively free of oxygen defects. Accordingly, the amount of ultraviolet light which is absorbed into oxygen defects decreases, and excitement of the luminescence center is facilitated. Hence the phosphor layer made up of these phosphor particles exhibits high luminance, without suffering from luminance deterioration associated with oxygen defects. Furthermore, according to hydrothermal synthesis it is possible to generate phosphor particles of submicron in size. This allows the phosphor material to be equally applied without unevenness, and improves the phosphor packing density in the phosphor layer, with it being possible to enhance the brightness of the PDP 100 in comparison with conventional PDPs.

Here, it is desirable that phosphor particles obtained by hydrothermal synthesis be used in all of the front phosphor layers 107R and 107G and the back phosphor layers 111R, 111G, and 111B in the PDP 100. However, even if phosphor particles by hydrothermal synthesis are used for one of these layers, the luminance of that layer increases and as a result the brightness of the PDP 100 is enhanced. More specifically, since the blue phosphor conventionally has lower luminance than other colored phosphors, the color temperature tends to drop when light of each of the three colors is emitted simultaneously. To overcome this, signal processing is conventionally performed to reduce the cell luminance of the phosphors (red and green) other than the blue phosphor, thereby controlling the color temperature in white reproduction. However, by using blue phosphor particles obtained by hydrothermal synthesis in the back phosphor layer 111B, the cell luminance in the blue color is enhanced without intentionally reducing the cell luminance in the other colors, with it being possible to make full use of the cell luminance in each of the three colors. This enables the brightness of the PDP 100 to be increased, while keeping the color temperature in white reproduction at high level.

(First Experiment)

(Samples Nos. 1 and 2)

In a sample No. 1, front phosphor layers are provided for red and green. In a sample No. 2, front phosphor layers are provided for red.

In both samples, the following phosphor particles are used.

| | |
|---|---|
| Red phosphor: | $(Y,Gd)BO_3$:Eu |
| Green phosphor: | $Zn_2SiO_4$:Mn |
| Blue phosphor: | $BaMgAl_{10}O_{17}$:Eu |

Also, both samples are 42-inch PDPs in which the height of the barrier ribs 110 is 0.1 mm, and the distance between neighboring barrier ribs 110, i.e. the cell pitch, is 0.36 mm. A discharge gas formed by a mixture of xenon (5%) and neon (95%) is filled in the discharge spaces 122 at a pressure of 66500 Pa. Also, in both back and front phosphor layers of the same color, phosphor particles created by the same manufacturing method are used.

(Sample No. 3)

In a sample No. 3 (reference sample), no front phosphor layers are provided. Apart from this difference, the sample No. 3 is the same as the samples Nos. 1 and 2.

(Experimental Conditions)

First, input power was adjusted so as to set the initial color temperature of each sample at 11000 K. After a white color was continuously displayed for 5000 hours, the color temperature of each sample was measured.

(Results and Consideration)

The experimental results are shown in TABLE 1.

(TABLE 1)

As can be seen from the table, the color temperatures of the samples Nos. 1 and 2 embodied above were measured 9500 K or higher, and did not decrease much even after 5000 hours of illumination. In particular, the sample No. 1 with the red and green front phosphor layers showed a color temperature as high as 10000 K.

On the other hand, the color temperature of the sample No. 3 decreased to 8000 K after 5000 hours.

The following conclusion can be drawn from the experimental results. By providing front phosphor layers in opposition to the red and green back phosphor layers other than the blue back phosphor layer whose luminance degrades fastest, the luminance degradation speeds of the red and green light are more balanced with the luminance degradation speed of the blue light. In so doing, the color temperature of the PDP can be effectively kept from decreasing with time.

Second Embodiment

The following is a description of a PDP according to the second embodiment of the invention, with reference to drawings.

The PDP of the second embodiment has a construction similar to the PDP of the first embodiment shown in FIGS. 2 to 5, and differs with the first embodiment only as to which of the three colors is provided with front phosphor layers. The following description focuses on this difference.

Figure 10:
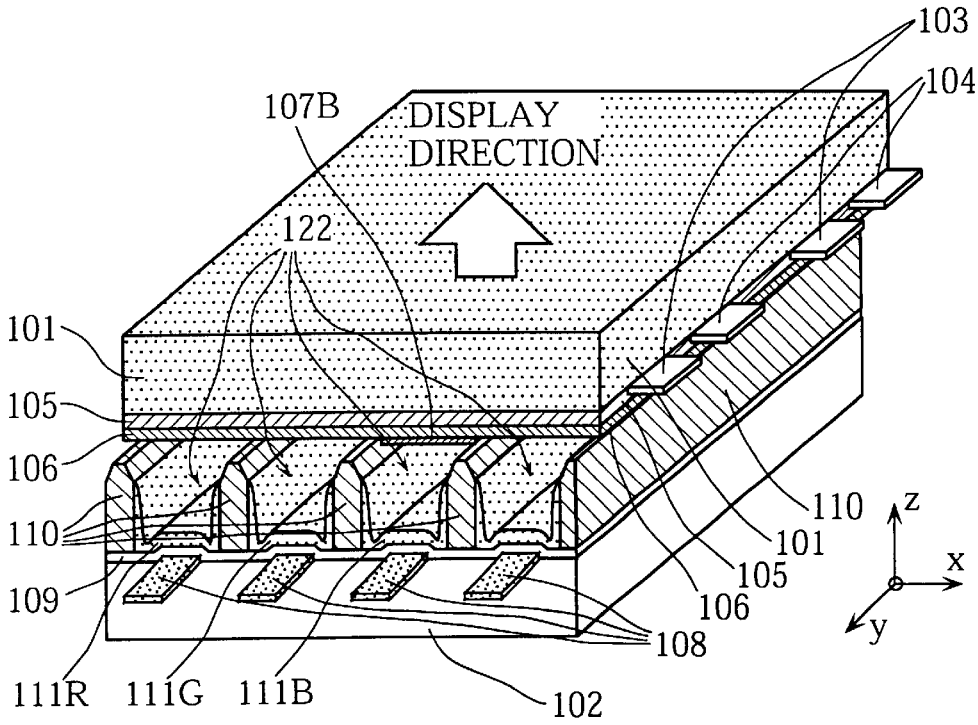
FIG. 10 is a partial perspective and sectional view of a PDP according to the second embodiment of the invention.

FIG. 10 is a partial perspective and sectional view of the PDP of the second embodiment. Note here that construction elements which are the same as those in the first embodiment shown in FIG. 3 have been given the same reference numerals and their explanation has been omitted.

In this PDP, a front phosphor layer 107B is provided in opposition to the back phosphor layer 111B whose initial luminance is the lowest of the back phosphor layers 111R, 111G, and 111B.

When the conventionally known red phosphor (Y,Gd) $BO_3$:Eu, green phosphor $Zn_2SiO_4$:Mn, and blue phosphor $BaMgAl_{10}O_{17}$:Eu are used, the order of the three phosphors, from highest to lowest initial luminance, is green, red, and blue. If the cell pitches of the back phosphor layers 111R, 111G, and 111B are the same, then the order of the three back phosphor layers, from highest to lowest initial luminance, is also green, red, and blue. This being so, if the three back phosphor layers are fully illuminated, the color balance of the PDP is disturbed, and the color temperature will end up being as low as about 5500 K. To ensure an initial color temperature of around 9000 K or higher, conventionally the use of the luminance of the red phosphor and the use of the luminance of the green phosphor are limited to approximately 55% and 76%, respectively. When the PDP produces a display at a predetermined color temperature in its initial state, the ratio of the actually used luminance to the overall luminance of each colored phosphor is hereinafter referred to as "initial luminance utilization factor". To make full use of the luminance of the red and green phosphors which have low initial luminance utilization factors so as to improve the brightness of the PDP 100 while maintaining the color temperature, it is necessary to increase the initial luminance of the blue light. To achieve this, the front phosphor layer 107B is provided in opposition to the back phosphor layer 111B in the second embodiment, thereby improving the initial blue light luminance.

The reason that the initial luminance of the blue light is increased by such a construction is as follows. When the PDP 100 is equipped with both of the front and back phosphor layers 107B and 111B, ultraviolet light generated at the time of discharge is more effectively converted into visible light, when compared with the case where the PDP 100 is equipped only with the back phosphor layer 111B.

To be more specific, if the front phosphor layer 107B is not present, part of ultraviolet light generated by discharge is absorbed into the front glass substrate 101, and cannot be put to use for light emission.

If, on the other hand, the front phosphor layer 107 is present, ultraviolet light generated by discharge excites both the back phosphor layer 111B and the front phosphor layer 107B, which accordingly emit light. By such effective use of ultraviolet light, the blue light luminance in the PDP 100 is increased. This enables the initial luminance of the red, green, and blue light to be more balanced. Accordingly, the color temperature and brightness of the PDP 100 in its initial state can be improved, with no need to adjust the cell pitches or limit the use of the luminance of the red and green phosphors, as was conventionally done. Here, it is more preferable that phosphor particles obtained by hydrothermal synthesis are used in the front phosphor layer 107B, so as to further enhance the luminance of the front phosphor layer 107B.

Also, it is desired that the front phosphor layer 107B has higher visible light transmittance than the back phosphor layer 111B. This is because if the visible light transmittance of the front phosphor layer 107B is lower than that of the back phosphor layer 111B, visible light emitted from the back phosphor layer 111B may not be able to pass through the front panel, which results in a drop in blue light luminance.

The visible light transmittance of the front phosphor layer 107B can be made higher than that of the back phosphor layer 111B, by setting the front phosphor layer 107B thinner than the back phosphor layer 111B, or by setting the voidage of the front phosphor layer 107B higher than that of the back phosphor layer 111B. The higher voidage of the front phosphor layer 107B can be attained, for example, by forming the front phosphor layer 107B using phosphor particles which are larger in particle diameter than those used for the back phosphor layer 111B.

Figure 11:
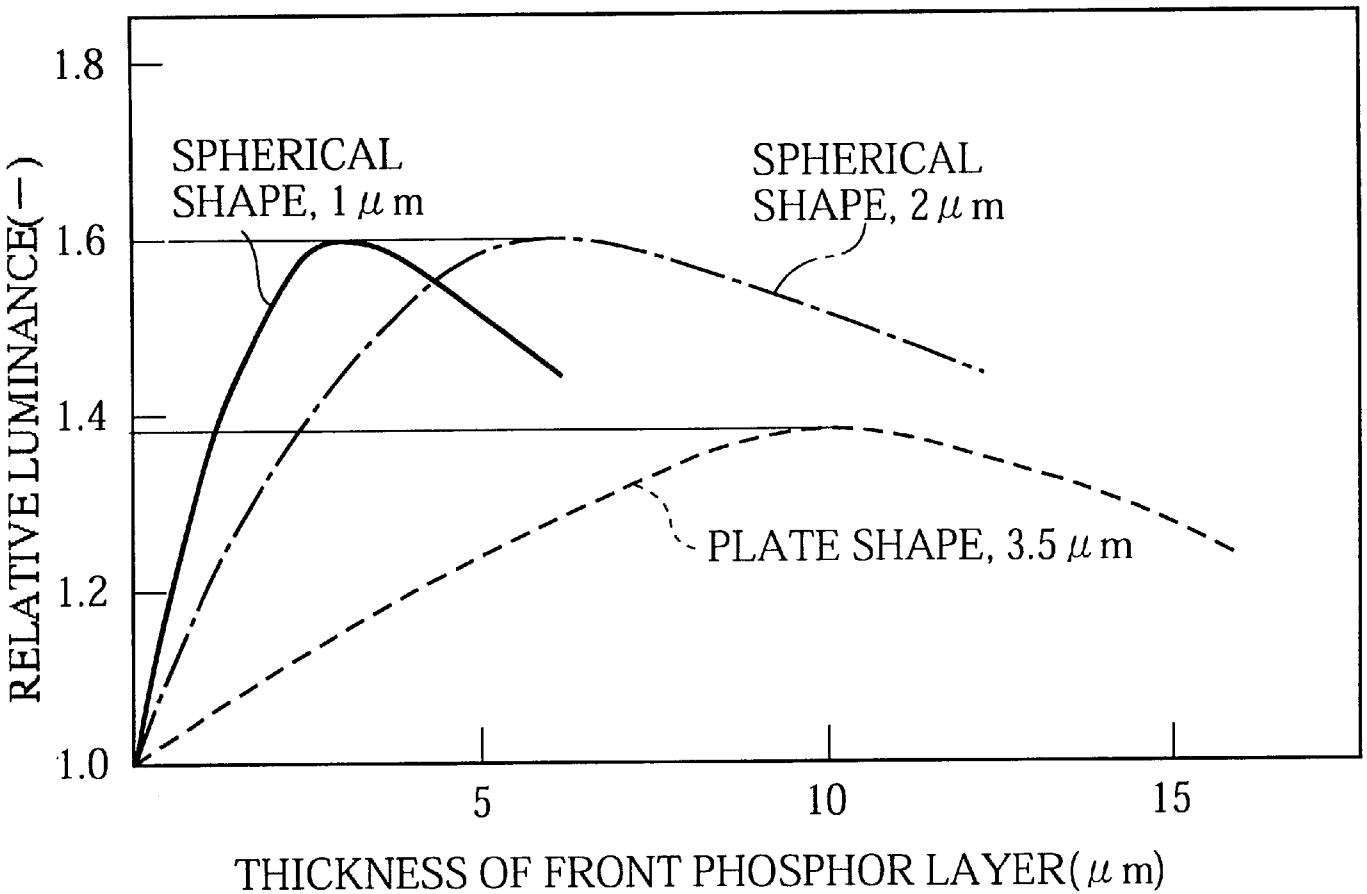
FIG. 11 shows the correlation between the thickness of a blue front phosphor layer and the relative luminance of blue light, when blue phosphor particles obtained by hydrothermal synthesis are used in the blue front phosphor layer.

FIG. 11 shows the relative luminance of blue light with respect to the thickness of the front phosphor layer 107B, in each of the cases where the front phosphor layer 107B is made up of three different types of phosphor particles.

When the front phosphor layer 107B is made up of phosphor particles obtained by firing (plate shape, 3.5 $\mu$m in average particle diameter), the relative luminance increases until the layer thickness increases to 10 $\mu$m, at which point the relative luminance reaches a maximum value of 1.4. After that, the relative luminance decreases. Accordingly, the thickness of the front phosphor layer 107B is preferably 10 $\mu$m or less in this case. In doing so, the amount of phosphor particles in the front phosphor layer 107B can be reduced, which benefits cost.

When the front phosphor layer 107B is made up of phosphor particles obtained by hydrothermal synthesis (spherical shape, 2 $\mu$m in average particle diameter), the relative luminance increases to a maximum value of 1.6 when the layer thickness increases to 6 $\mu$m, and after that the relative luminance decreases. Likewise, when the front phosphor layer 107B is made up of phosphor particles obtained by hydrothermal synthesis (spherical shape, 1 $\mu$m in average particle diameter), the relative luminance increases to a maximum value of 1.6 when the layer thickness increases to 3 $\mu$m, and after that the relative luminance decreases. Thus, if phosphor particles made by hydrothermal synthesis are used, the relative luminance can be increased by about 20% and at the same time the layer thickness can be reduced, when compared with the case where phosphor particles obtained by firing are used.

This is because phosphor particles obtained by hydrothermal synthesis exhibit high luminance, and also their spherical shape contributes to a larger total surface area that contributes to light emission than plate-shaped phosphor particles. Here, the smaller the particle diameter, the higher luminance can be obtained.

Also, the voidage of the front phosphor layer 107B is preferably 50% or higher.

This embodiment describes an example in which front phosphor layers are provided for the back phosphor layer 111B. However, when adjusting the color balance of the PDP 100 to produce a display at a predetermined color temperature (e.g. 9000 K), front phosphor layers may be provided for the back phosphor layers 111B and 111G, that is, the back phosphor layers other than the back phosphor layer 111R whose initial luminance utilization factor is the lowest. By doing so, the initial color temperature and brightness of the PDP 100 can be improved, though to a lesser extent. Alternatively, front phosphor layers may be provided for all of the back phosphor layers 111R, 111G, and 111B. In such a case, the red front phosphor layer is given a sufficient thickness so as to decrease its visible light transmittance, while the blue front phosphor layer is given an appropriate thickness so as to maximize the luminance of blue light emitted from the front and back phosphor layers. By such adjusting the luminance of each phosphor layer, the initial color temperature and brightness of the PDP 100 can be improved.

(Second Experiment)

(Samples Nos. 4 to 7)

In samples Nos. 4 to 6, front phosphor layers are provided for blue, with the layer thickness and voidage being varied in each sample as shown in TABLE 2. In a sample No. 7, front phosphor layers are provided for blue and green. Apart from these, the samples Nos. 4 to 7 have the same construction as the PDP 100 in the second embodiment.

Also, in the samples Nos. 4 to 7, the thickness of each back phosphor layer is 30 $\mu$m, with visible light transmittance being no greater than 10%.

(Reference Sample)

In a sample No. 8 (reference sample), back phosphor layers of the three colors are provided.

(Experimental Conditions)

In each of the samples Nos. 4 to 8, a white color was displayed with 100% of initial luminance utilization factor for each color, and the color temperature was measured.

(Results and Consideration)

The experimental results are shown in TABLE 2.

(TABLE 2)

As shown in the table, the color temperature of each of the samples Nos. 4 to 6 equipped with blue front phosphor layers exceeded 10000 K. Here, the higher the visible light transmittance, the higher color temperature was observed. Especially, in the sample No. 5 with the visible light transmittance of 80%, the color temperature was as high as 10500 K. In the sample No. 6, the initial color temperature was slightly lower than the samples Nos. 4 and 5 because of lower visible light transmittance due to greater layer thickness, but still as high as 10000 K.

In the sample No. 7, the color temperature was a little lower than the samples Nos. 4 to 6 (9000 K), but still acceptable for practical use.

On the other hand, the color temperature of the sample No. 8 showed a very low value of 6000 K. This low color temperature can be attributed to the fact that the color balance was disturbed by low luminance of the blue back phosphor layer.

Modifications

The first and second embodiments describe an example in which the barrier ribs 110 have a stripe shape, but the barrier ribs 110 may have a meandering shape, or they may be arranged in a lattice pattern.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

TABLE 1

| SAMPLE NUMBER | COLOR OF FRONT PHOSPHOR LAYER | INITIAL COLOR TEMPERATURE (K) | COLOR TEMPERATURE AFTER 5000 HOURS (K) |
|---|---|---|---|
| 1 | RED, GREEN | 11000 | 10000 |
| 2 | RED | 11000 | 9500 |
| 3 | NONE | 11000 | 8000 |

TABLE 2

| SAMPLE NUMBER | COLOR OF FRONT PHOSPHOR LAYER | THICKNESS OF FRONT PHOSPHOR LAYER (μm) | VOIDAGE OF FRONT PHOSPHOR LAYER (%) | VISIBLE LIGHT TRANSMITTANCE OF FRONT PHOSPHOR LAYER (%) | INITIAL COLOR TEMPERATURE (K) |
|---|---|---|---|---|---|
| 4 | BLUE | 5 | 60 | 60 | 10200 |
| 5 | BLUE | 5 | 80 | 80 | 10500 |
| 6 | BLUE | 10 | 80 | 50 | 10000 |
| 7 | BLUE, GREEN | 5 | 80 | 80 | 6000 |
| 8 | NONE | — | — | — | 6000 |

What is claimed is:

1. A plasma display panel comprising:

a front panel including a front substrate and at least one pair of electrodes, the at least one pair of electrodes being aligned on a main surface of the front substrate; and a back panel including a back substrate, barrier ribs, and at least one set of three back phosphor layers that emit visible light in each of colors red, green, and blue when excited by ultraviolet light generated by a discharge between the at least one pair of electrodes in the front panel, the barrier ribs being aligned on a main surface of the back substrate with gaps therebetween, and a different one of the three back phosphor layers being formed in each of the gaps between adjacent barrier ribs on the main surface of the back substrate, the back panel being opposed to the front panel with the barrier ribs interposed in between, wherein the front panel includes at least one front phosphor layer formed on the main surface of the front substrate, the at least one front phosphor layer (a) being opposed, in a one-to-one correspondence, to at least one back phosphor layer other than a back phosphor layer whose luminance degrades fastest with time among the red, green, and blue back phosphor layers, and (b) emitting light of the same color as the at least one opposite back phosphor layer.

2. The plasma display panel of claim 1, wherein the at least one front phosphor layer is a red front phosphor layer formed in opposition to the red back phosphor layer.

3. The plasma display panel of claim 1, wherein the at least one front phosphor layer consists of a red front phosphor layer and a green front phosphor layer that are respectively formed in opposition to the red back phosphor layer and the green back phosphor layer.

4. The plasma display panel of claim 1, wherein the at least one front phosphor layer has a higher visible light transmittance than the at least one opposite back phosphor layer.

5. The plasma display panel of claim 4, wherein the at least one front phosphor layer is thinner than the at least one opposite back phosphor layer.

6. The plasma display panel of claim 5, wherein the at least one front phosphor layer is made up of phosphor particles whose average diameter does not exceed 3.5 μm, and the at least one front phosphor layer is no thicker than 10 μm.

7. The plasma display panel of claim 4, wherein the at least one front phosphor layer has a greater voidage than the at least one opposite back phosphor layer.

8. The plasma display panel of claim 1, wherein the at least one front phosphor layer is formed on part of the main surface of the front substrate where the at least one pair of electrodes are not aligned.

9. The plasma display panel of claim 1, wherein the gaps between the adjacent barrier ribs have different sizes depending on differences in luminance of the three back phosphor layers formed therein.

10. The plasma display panel of claim 1, wherein at least one of the front and back phosphor layers included in the plasma display panel is made up of phosphor particles which are spherical in shape.

11. The plasma display panel of claim 10, wherein the phosphor particles are prepared by hydrothermal synthesis.

12. A PDP-equipped display device, comprising the plasma display panel of claim 1, and a display drive circuit that is connected to the at least one pair of electrodes in the plasma display panel and drives the plasma display panel by applying a voltage to the at least one pair of electrodes.

13. A plasma display panel comprising:

a front panel including a front substrate and at least one pair of electrodes, the at least one pair of electrodes being aligned on a main surface of the front substrate; and a back panel including a back substrate, barrier ribs, and at least one set of three back phosphor layers that emit visible light in each of colors red, green, and blue when excited by ultraviolet light generated by a discharge between the at least one pair of electrodes in the front panel, the barrier ribs being aligned on a main surface of the back substrate with gaps therebetween, and a different one of the three back phosphor layers being formed in each of the gaps between adjacent barrier ribs on the main surface of the back substrate, the back panel being opposed to the front panel with the barrier ribs interposed in between, wherein the front panel includes at least one front phosphor layer formed on the main surface of the front substrate, the at least one front phosphor layer (a) being opposed, in a one-to-one correspondence, to at least one back phosphor layer other than a back phosphor layer whose initial luminance utilization factor, when the plasma display panel produces a display at a predetermined color temperature, is the lowest among the red, green, and blue back phosphor layers, and (b) emitting light of the same color as the at least one opposite back phosphor layer.

14. The plasma display panel of claim 13, wherein the at least one front phosphor layer consists of a green front phosphor layer and a blue front phosphor layer that are respectively formed in opposition to the green back phosphor layer and the blue back phosphor layer.

15. The plasma display panel of claim 13, wherein the at least one front phosphor layer is a blue front phosphor layer formed in opposition to the blue back phosphor layer.

16. The plasma display panel of claim 13, wherein the at least one front phosphor layer has a higher visible light transmittance than the at least one opposite back phosphor layer.

17. The plasma display panel of claim 16, wherein the at least one front phosphor layer is thinner than the at least one opposite back phosphor layer.

18. The plasma display panel of claim 17, wherein the at least one front phosphor layer is made up of phosphor particles whose average diameter does not exceed 3.5 $\mu$m, and the at least one front phosphor layer is no thicker than 10 $\mu$m.

19. The plasma display panel of claim 16, wherein the at least one front phosphor layer has a greater voidage than the at least one opposite back phosphor layer.

20. The plasma display panel of claim 13, wherein the at least one front phosphor layer is formed on part of the main surface of the front substrate where the at least one pair of electrodes are not aligned.

21. The plasma display panel of claim 13, wherein the gaps between the adjacent barrier ribs have different sizes depending on differences in luminance of the three back phosphor layers formed therein.

22. The plasma display panel of claim 13, wherein at least one of the front and back phosphor layers included in the plasma display panel is made up of phosphor particles which are spherical in shape.

23. The plasma display panel of claim 22, wherein the phosphor particles are prepared by hydrothermal synthesis.

24. The plasma display panel of claim 23, wherein the phosphor p articles are blue phosphor particles.

25. A PDP-equipped display device, comprising the plasma display panel of claim 13, and a display drive circuit that is connected to the at least one pair of electrodes in the plasma display panel and drives the plasma display panel by applying a voltage to the at least one pair of electrodes.

26. A plasma display panel comprising:

a front panel including a front substrate and at least one pair of electrodes, the at least one pair of electrodes being aligned on a main surface of the front substrate; and a back panel having a back substrate, barrier ribs, and at least one set of three back phosphor layers that emit visible light in each of colors red, green, and blue when excited by ultraviolet light generated by a discharge between the at least one pair of electrodes in the front panel, the barrier ribs being aligned on a main surface of the back substrate with gaps therebetween, and a different one of the three back phosphor layers being formed in each of the gaps between adjacent barrier ribs on the main surface of the back substrate, the back panel being opposed to the front panel with the barrier ribs interposed in between, wherein the front panel includes at least one set of three front phosphor layers formed on the main surface of the front substrate, the three front phosphor layers (a) being opposed, in a one-to-one correspondence, to the red, green, and blue back phosphor layers in the back panel, and (b) each emitting light of the same color as the opposite back phosphor layer, and a front phosphor layer, which is opposite to a back phosphor layer whose luminance degrades slowest over time or whose initial luminance utilization factor is the lowest among the red, green, and blue back phosphor layers, has a lower visible light transmittance than the other two front phosphor layers.

* * * * *